US007438254B2

(12) United States Patent
Oettershagen

(10) Patent No.: US 7,438,254 B2
(45) Date of Patent: Oct. 21, 2008

(54) WIND-OFF DEVICE

(75) Inventor: Bodo Oettershagen, Wiehl (DE)

(73) Assignee: Illinois Tool Works Inc., Glenview, IL (US)

( * ) Notice: Subject to any disclaimer, the term of this patent is extended or adjusted under 35 U.S.C. 154(b) by 223 days.

(21) Appl. No.: 11/351,256

(22) Filed: Feb. 10, 2006
(Under 37 CFR 1.47)

(65) Prior Publication Data

US 2007/0045465 A1 Mar. 1, 2007

(30) Foreign Application Priority Data

Feb. 12, 2005 (DE) ..... 20 2005 002 248 U

(51) Int. Cl.
*B65H 75/18* (2006.01)

(52) U.S. Cl. ..... 242/596.7; 242/596; 242/599.4

(58) Field of Classification Search ..... 242/596, 242/596.4, 596.7, 599.4, 612, 118.61
See application file for complete search history.

(56) References Cited

U.S. PATENT DOCUMENTS

| | | | | |
|---|---|---|---|---|
| 3,521,833 | A * | 7/1970 | Ridgeway, Jr. et al. | 242/118.61 |
| 4,171,781 | A * | 10/1979 | Kral et al. | 242/612 |
| 5,322,234 | A * | 6/1994 | Robert et al. | 242/596.7 |
| 5,597,135 | A * | 1/1997 | Vandersteene | 242/599.4 |
| 6,491,252 | B2 * | 12/2002 | Komatsu et al. | 242/596.7 |
| 6,883,292 | B1 * | 4/2005 | Chen | |

* cited by examiner

*Primary Examiner*—William A Rivera
(74) *Attorney, Agent, or Firm*—Lowe, Hauptman, Ham & Berner, LLP

(57) ABSTRACT

A wind-off assistance device for coreless film rolls comprises two receiving element being insertable into a coreless film roll. The receiving element are connected to each other via a cylindrical connection element. The two receiving element are surrounded by a ring-shaped bearing so that the film roll is rotatably connected to the receiving element. A second bearing ring is located between the cylindrical connection element and the receiving element so that the connection element can be rotated on the receiving element.

10 Claims, 2 Drawing Sheets

WIND-OFF DEVICE

RELATED APPLICATIONS

The present application is based on, and claims priority from, German Application Number 20 2005 002 248.9, filed Feb. 10, 2005, the disclosure of which is hereby incorporated by reference herein in its entirety.

FIELD OF THE INVENTION

The present invention relates to a wind-off device configured to accommodate coreless film rolls.

BACKGROUND OF THE INVENTION

For the packing and securing of bulky goods to bring them into proper condition for transportation, use is made of pre-stretched films which are referred to as stretch films. The stretch films are available in the form of stretch film rolls. Presently, to avoid waste, coreless film rolls have been introduced on the market, i.e. film rolls without a cardboard core or the like. Due to the absence of the core, a special wind-off assistance device has to be used for winding off the film roll and for applying the film on a given object.

Known from EP 1 120 347 A2 is a wind-off assistance device which substantially consists of two receiving means connected to each other by an axial connection element. The film roll is supported for rotation on these two receiving means. The outer diameter of the connection element is considerably smaller than the inner diameter of the film roll so that the connection element cannot impede the rotational movement of the film roll when the film is wound off.

During the winding-off of the final innermost film layers, the rest of the film roll has become so instable and flabby that it will tend to undergo torsional deformation and/or be deformed in some other manner. For these reasons, the final 20 to 30meters of the length of a coreless film roll cannot be wound off anymore.

Thus, it is an object of the present invention to provide a wind-off assistance device for coreless film rolls which makes it possible that the film roll can be wound off completely.

According to the present invention, the above object is achieved by the features indicated in claim 1.

SUMMARY OF THE INVENTION

In the wind-off assistance device of the invention, the receiving means each comprise a connection-element bearing for rotatable support of the connection element relative to the receiving means. The coreless film roll is held by the film roll bearings substantially on both longitudinal ends of the roll. The outer diameter of the connection element is selected to the effect that the connection element can be shifted through the coreless film roll almost without resistance and the innermost layers of the film roll are supported. By the rotatable support of the connection element, it is safeguarded that the innermost film layers of the film roll can be wound off virtually without resistance.

On the one hand, the above described construction will guarantee the fixation of the film roll on its longitudinal ends. On the other hand, the coreless film roll is stabilized from within so that the innermost film layers can be wound off in a condition free of torsional deformation and other deformation. By the fixation of the coreless film roll on its longitudinal ends, it is safeguarded that a coreless film roll can be mounted to the wind-off assistance device in a simple manner and unimpeded by resistance. By the provision of the connection element which is rotatable and will lend support to the innermost film layers, a nearly ideal wind-off behavior during the wind-off movement of the innermost film layers of the film roll is guaranteed. The film roll can be wound of in a taut condition up to and including the last meter of its length.

Preferably, the outer diameter of the connection element is maximally by 2.0 cm smaller than the inner diameter of the film roll, so that the connection element has a slightly smaller inner diameter than the inner diameter of the coreless film roll. In this manner, it is safeguarded that, when the connection element is inserted into the tubular hollow space in the interior of the coreless film roll, the innermost film layer of the film roll will not be deformed or displaced and that, while the innermost layers of the film roll are wound off, the film roll is supported to protect the same from deformation.

According to a preferred embodiment, the connection-element bearing is a slide bearing, and the connection-element bearing can comprise a slide ring. The slide ring can be tightly attached to a receiving body or be tightly attached to the connection element.

According to a preferred embodiment, the slide ring comprises self-lubricating material. In this manner, a low-resistance rotary support of the connection element on the receiving means will be safeguarded throughout a long service life.

Preferably, the slide rings are axially secured in a receiving body of the receiving means. This securement of the slide rings to the receiving body can be effected by means of a ring, by bonding, by welding or by insertion into a peripheral groove of the receiving body.

According to a preferred embodiment, the connection element has its longitudinal ends provided with a respective conically tapered shape on its outer sides, thus presenting a taper adapted to facilitate the threading of the longitudinal end of the connection element into the hollow space of the coreless film roll during the mounting of the film roll with the wind-off assistance device. During the inserting of the connection element, this configuration reliably prevents a deformation of the film roll in the region of the openings on the longitudinal sides.

Preferably, the connection element has its outer sides provided with radial longitudinal ribs. The outer diameter defined by the outer edges of the longitudinal ribs can be relatively large, e.g. approximately as large as the inner diameter of the film roll. By the ribbed configuration of the outer periphery of the connection element, it is safeguarded that the insertion of the connection element into the film roll can be performed against merely little resistance so that the innermost film layers of the film roll will not be displaced in the process.

According to a preferred embodiment, the connection-element bearing is formed with an axial abutment flange. The axial abutment flange serves for axial fixation of the connection element to the axial abutment flange. Thereby, it is prevented that the receiving means extend too far into the coreless film roll.

According to a further independent claim, the wind-off assistance device for coreless film rolls comprises two receiving means and a connection element which axially connects the receiving means and in turn carries the film roll. The receiving means each comprise a connection-element bearing for rotatable support of the connection element relative to the receiving means.

Further, the connection element is adapted to be separated from the receiving means on at least one longitudinal end and has its separable longitudinal end formed with a conical taper. Thus, by the provision of merely two bearings, there is obtained a wind-off assistance device for coreless film rolls which makes it is possible that also of the innermost film layers of the film roll can be wound off in a stable manner.

By way of alternative to the above arrangement, the connection element can be configured to be separable into two parts wherein each of the resultant connection element parts together with the associated receiving means can be inserted into the film roll from one side of the film roll; within the film roll, the two parts can be connected to each other by plugging them into each other.

An embodiment of the invention will be explained in greater detail hereunder with reference to the accompanying drawings.

DETAILED DESCRIPTION OF A PREFERRED EMBODIMENT

Figure 1:
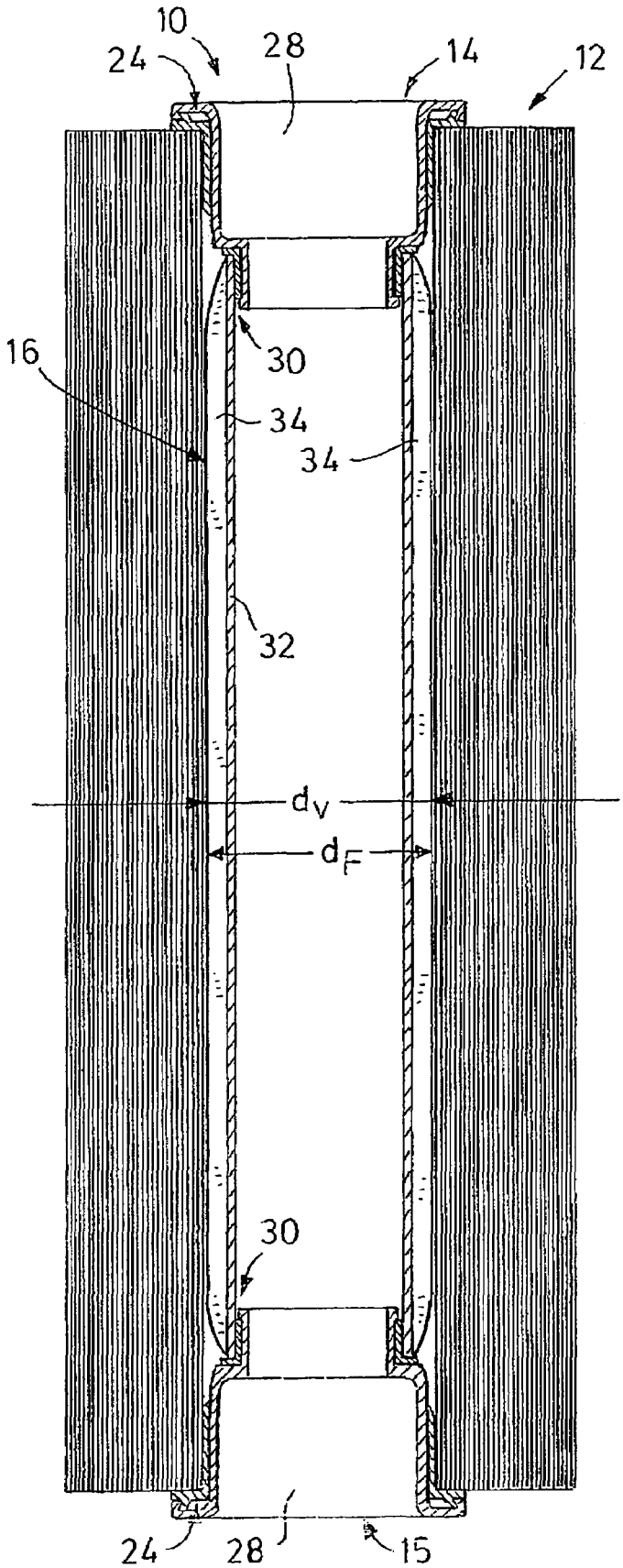
FIG. 1 is a longitudinal sectional view of a wind-off assistance device according to the invention.
Figure 2:
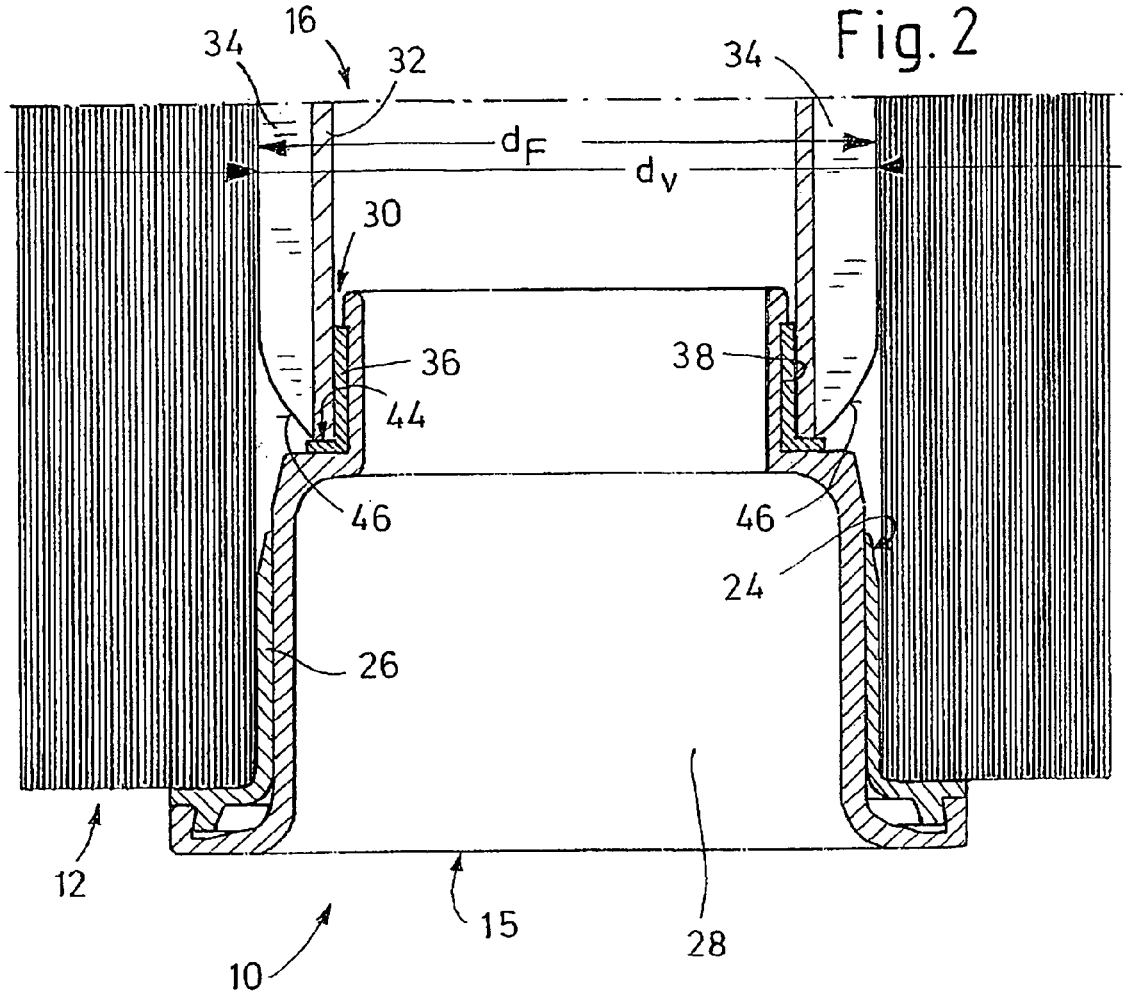
FIG. 2 is an enlarged representation of a receiving element of the wind-off assistance device according to FIG. 1.
Figure 3:
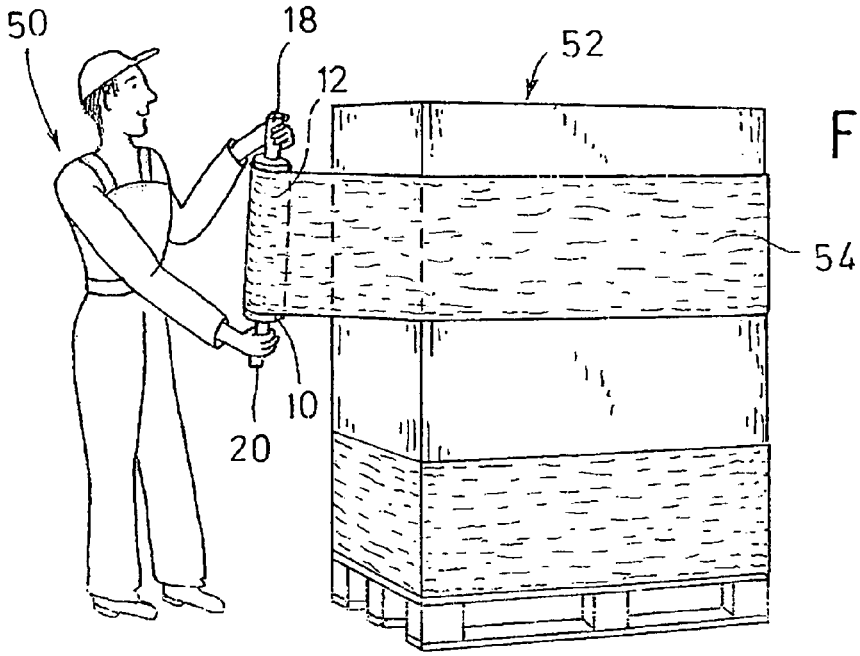
FIG. 3 is a general view of the wind-off assistance device according to FIGS. 1 and 2 while being used.

FIGS. 1 to 3 illustrate a wind-off assistance device 10 holding a coreless cylindrical film roll 12. Film roll 12 is formed by a continuous plastic film rolled into a plurality of film layers. The plastic film serves for the packaging of goods and is provided as a so-called stretch film, i.e. the plastic film is biased.

The film roll 12 is held by the wind-off assistance device 10 which substantially comprises two receiving means 14,15 arranged on the lateral ends of film roll 12, a connection element 16 as well as two handles 18,20.

The lower receiving means 15, of which an enlarged view is presented in FIG. 2, comprises a film roll bearing 24. This film roll bearing 24 is substantially formed by a slide ring 26 arranged to rotatingly slide on a receiving body 28 which in this region is of a cylindrical shape. Slide ring 26 is axially fixed. Film roll 12 is externally shifted onto slide ring 26 in a manner precluding rotation of film roll 12 on slide ring 26. When the wind-off assistance device 10 is used, handle 20 will have been placed into its inserted position on the device. The upper receiving means 14 is of the same configuration.

The receiving means 14,15 comprise, apart from film roll bearing 24, respectively a second bearing, notably a connection-element bearing 30. By means of the connection-element bearing 30, the connection element 16 is supported for rotation on the receiving means 14,15. Connection element 16 is formed by a cylindrical tubular body 32 and a plurality of radial longitudinal ribs 34. The outer diameter $d_v$ of connection element 16, i.e. the diameter defined by the outer edges of the longitudinal ribs 34, is slightly smaller than the inner diameter $d_F$ of film roll 12, and is particularly by a few millimeters smaller than the inner diameter $d_F$ of film roll 12.

The connection-element bearing 30 substantially comprises a cylindrical slide ring 36 axially fixed in a peripheral grove 38 of receiving body 28. Slide ring 36 is formed with an axial abutment flange 44 and comprises a self-lubricating material, e.g. a plastic ring with embedded lubricating bodies.

Connection element 16 is externally tapered on its two longitudinal ends whereby tapers 46 are formed. These tapers 46 are realized by a reduction of the rib radius and the rib height, respectively, of the longitudinal ribs 34 in the direction towards the longitudinal ends of connection element 16.

When a film roll 12 is to be placed in position, connection element 16 can at least on one of the two connection-element bearings 30 be axially withdrawn from the respective slide ring 36 and, after insertion of connection element 16 into the hollow cylindrical film roll 12, be shifted back onto the respective slide ring 36 to be clamped thereto.

After the film roll 12 has been placed on the wind-off assistance device 10 and also the handles 18,20 have been installed on device 10, the user 50 can pack a large-volume commodity item 52 by winding off the film sheet 54 under slight tension from the film roll 12 held by the wind-off assistance device 10, as illustrated in FIG. 3.

The invention claimed is:

1. A wind-off assistance device for coreless film rolls, comprising two receiving elements, and a connection element axially extending between and interconnecting the receiving elements, the connection element having radially extending longitudinal ribs extending along its external surface which are adapted to have film wound directly thereon, each receiving element comprising a film-roll bearing for rotatable support of film wound thereon, and wherein the receiving elements each comprise a connection-element bearing for rotatable support of the connection element relative to each of the receiving element.

2. The wind-off assistance device according to claim 1, wherein the outer diameter $d_v$ of the connection element is at the maximum 2.0 cm less than the inner diameter $d_F$ of the film roll.

3. The wind-off assistance device according to claim 1, wherein the connection element bearings are slide bearings.

4. The wind-off assistance device according to claim 1, wherein the connection element has its longitudinal ends provided with a respective taper on its outer sides.

5. The wind-off assistance device according to claim 1, wherein the connection-element bearings are formed with an axial abutment flange.

6. A wind-off assistance device for coreless film rolls, comprising two receiving element, and a connection element axially connecting the receiving element, each receiving element comprising a film-roll bearing for rotatable supporting the film roll, wherein the receiving element each comprise a connection-element bearing for rotatable support of the connection element relative to each of the receiving element, wherein the connection element bearings are slide bearings, and , wherein each connection-element bearing comprises a respective slide ring.

7. The wind-off assistance device according to claim 6, wherein the slide ring comprises self-lubricating material.

8. The wind-off assistance device according to claim 6, wherein the slide rings are axially secured in the respective receiving body.

9. The wind-off assistance device according to claim 8, wherein the slide rings are respectively seated in a circumferential groove of the receiving body.

10. A wind-off assistance device for coreless film rolls, comprising two receiving elements and a connection element axially connecting the receiving elements, the receiving elements and the connection element being configured to have film corelessly wound thereon, the receiving elements each comprising a connection-element bearing for rotatable supporting the connection element relative to the receiving element, and wherein the connection element has radially extending, longitudinally ribs extending along its external surface which are configured to have film wound directly thereon, the connection element being configured to be separated from the receiving elements on at least one longitudinal end and has its separable longitudinal end formed with a taper.

* * * * *